US009920469B2

(12) United States Patent
Ramprasad et al.

(10) Patent No.: US 9,920,469 B2
(45) Date of Patent: Mar. 20, 2018

(54) DRYER APPLIANCE AND A METHOD FOR OPERATING A DRYER APPLIANCE

(71) Applicant: General Electric Company, Schenectady, NY (US)

(72) Inventors: Lakkineni Venkat Ramprasad, Bangalore (IN); Shree Kumar, Bangalore (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 843 days.

(21) Appl. No.: 14/282,269

(22) Filed: May 20, 2014

(65) Prior Publication Data

US 2015/0337483 A1 Nov. 26, 2015

(51) Int. Cl.

| | |
|---|---|
| ***D06F 58/22*** | (2006.01) |
| ***D06F 58/28*** | (2006.01) |
| *D06F 58/04* | (2006.01) |

(52) U.S. Cl.

CPC ..... *D06F 58/22* (2013.01); *D06F 58/04* (2013.01); *D06F 58/28* (2013.01); *D06F 2058/2858* (2013.01)

(58) Field of Classification Search

CPC ..... D06F 58/22; D06F 58/04; D06F 58/28; D06F 2058/2858; F26B 21/00; F26B 21/003

See application file for complete search history.

(56) References Cited

U.S. PATENT DOCUMENTS

| | | | | | |
|---|---|---|---|---|---|
| 2,408,921 | A * | 10/1946 | Esson | F24B 13/008 | 126/15 R |
| 2,843,945 | A * | 7/1958 | Whyte | D06F 58/02 | 34/601 |
| 3,085,348 | A * | 4/1963 | Adey | D06F 58/22 | 34/82 |
| 4,314,409 | A * | 2/1982 | Cartier | D06F 58/22 | 34/604 |
| 4,700,492 | A | 10/1987 | Werner et al. | | |
| 4,899,462 | A * | 2/1990 | Putnam | D06F 58/22 | 34/428 |
| 4,971,026 | A * | 11/1990 | Fineblum | F24H 9/0063 | 126/110 R |
| 6,158,148 | A * | 12/2000 | Krausch | D06F 58/28 | 34/497 |
| 6,840,974 | B2 * | 1/2005 | Bailey | B01D 46/0056 | 55/283 |
| 2010/0212367 | A1 * | 8/2010 | Kim | D06F 58/22 | 68/19 |

(Continued)

FOREIGN PATENT DOCUMENTS

| | | | | |
|---|---|---|---|---|
| EP | 3135805 | A1 * | 3/2017 | D06F 58/22 |
| WO | WO 2011/042345 | A1 | 4/2011 | |

*Primary Examiner* — Jianying Atkisson
*Assistant Examiner* — Tavia Sullens
(74) *Attorney, Agent, or Firm* — Dority & Manning, P.A.

(57) ABSTRACT

A dryer appliance is provided. The dryer appliance includes a filter assembly with a filter medium. A first portion of the filter medium is disposed within an exhaust conduit when the filter medium is in a first position. A second portion of the filter medium is disposed within the exhaust conduit when the filter medium is in a second position. A method for operating a dryer appliance is also provided.

11 Claims, 6 Drawing Sheets

(56) References Cited

U.S. PATENT DOCUMENTS

| | | | | |
|---|---|---|---|---|
| 2010/0212368 | A1* | 8/2010 | Kim | D06F 58/22 68/19 |
| 2011/0173834 | A1* | 7/2011 | Arrigoni | D06F 58/22 34/90 |
| 2011/0271542 | A1* | 11/2011 | Ko | D06F 58/22 34/90 |

* cited by examiner

DRYER APPLIANCE AND A METHOD FOR OPERATING A DRYER APPLIANCE

FIELD OF THE INVENTION

The present subject matter relates generally to dryer appliances and filters for dryer appliances.

BACKGROUND OF THE INVENTION

Dryer appliances are generally provided with a filter for collecting lint and other particles from air flowing through the dryer appliances. During a drying cycle, a large volume of lint can collect on the filter. Users of dryer appliances are normally instructed to clean the filter and remove collected lint from the filter between drying cycles. However, it can be difficult and/or inconvenient to frequently remove lint from the filter, and certain consumers forget to regularly clean the filter and/or disregard the cleaning instructions.

Lint disposed on the filter can restrict air flow through the dryer appliance and negatively affect performance of the dryer appliance. For example, restricted air flow through a drum of the dryer appliance can raise a temperature of air within the drum and damage clothing articles within the drum. As another example, a thermostat or other temperature regulating device of the dryer appliance may trip due to the increased temperature within the drum causing the drying cycle to be extended. Thus, an efficiency of the dryer appliance may be negatively affected when excessive lint is disposed on the dryer appliance's filter.

Accordingly, a dryer appliance with features for facilitating cleaning of a filter of the dryer appliance would be useful. In particular, a dryer appliance with features for removing lint from a filter of the dryer appliance and storing the lint for multiple drying cycles would be useful.

BRIEF DESCRIPTION OF THE INVENTION

The present subject matter provides a dryer appliance is provided. The dryer appliance includes a filter assembly with a filter medium. A first portion of the filter medium is disposed within an exhaust conduit when the filter medium is in a first position, and a second portion of the filter medium is disposed within the exhaust conduit when the filter medium is in a second position. Additional aspects and advantages of the invention will be set forth in part in the following description, or may be apparent from the description, or may be learned through practice of the invention.

In a first exemplary embodiment, a dryer appliance is provided. The dryer appliance includes a cabinet that defines a vent. A drum is rotatably mounted within the cabinet. The drum defines a chamber for receipt of articles for drying. An exhaust conduit extends between the chamber of the drum and the vent of the cabinet. A filter assembly is positioned at the exhaust conduit. The filter assembly includes a filter medium having a first portion and a second portion. The filter medium is rotatable between a first position and a second position. The first portion of the filter medium is disposed within the exhaust conduit when the filter medium is in the first position. The second portion of the filter medium is disposed within the exhaust conduit when the filter medium is in the second position. A motor is coupled to the filter medium. The motor is operable to rotate the filter medium between the first and second positions.

In a second exemplary embodiment, a method for operating a dryer appliance is provided. The method includes initiating a drying operation of the dryer appliance, directing a flow of lint laden air out of a drum of the dryer appliance during the drying operation and collecting lint from the flow of lint laden air on a first portion of a filter medium during the drying operation. A second portion of the filter medium is not disposed within the flow of lint laden air during the step of collecting. The method also includes rotating the filter medium from a first position to a second position after the step of collecting and gathering lint from the flow of lint laden air on the second portion of the filter medium during the drying operation after the step of rotating. The first portion of the filter medium is not disposed within the flow of lint laden air during the step of gathering.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
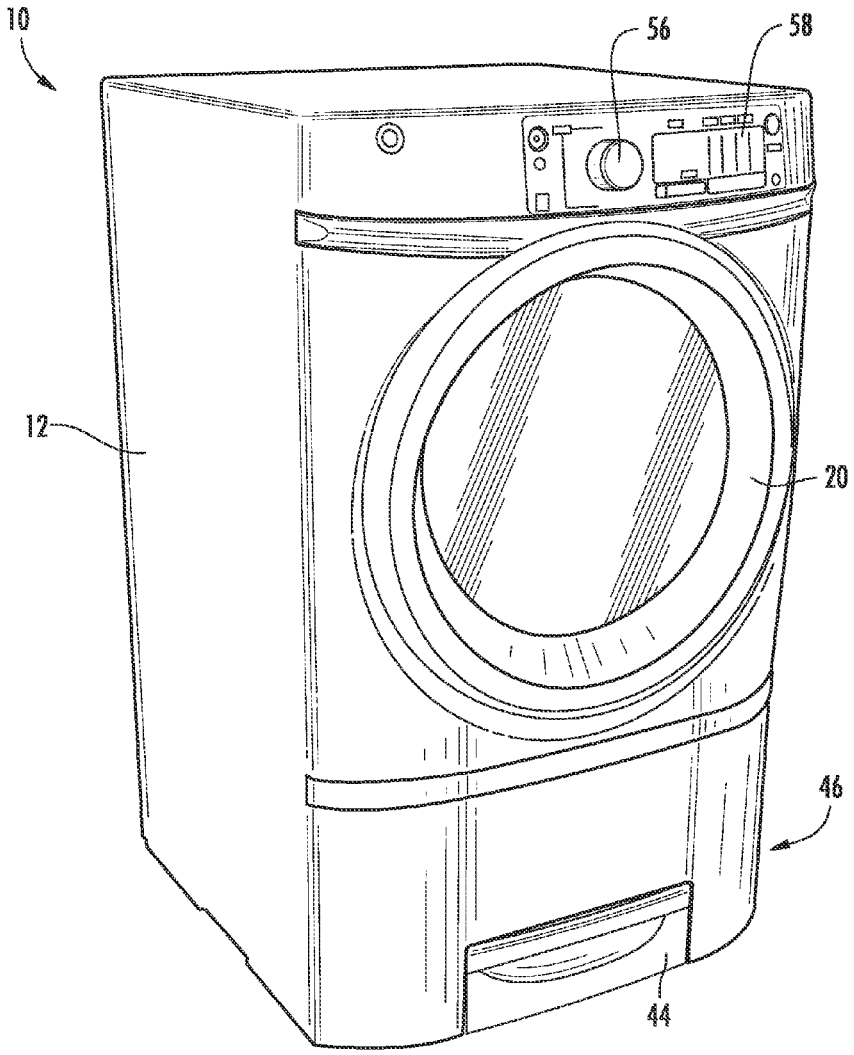
FIGS. 1 and 2 provide perspective views of a dryer appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
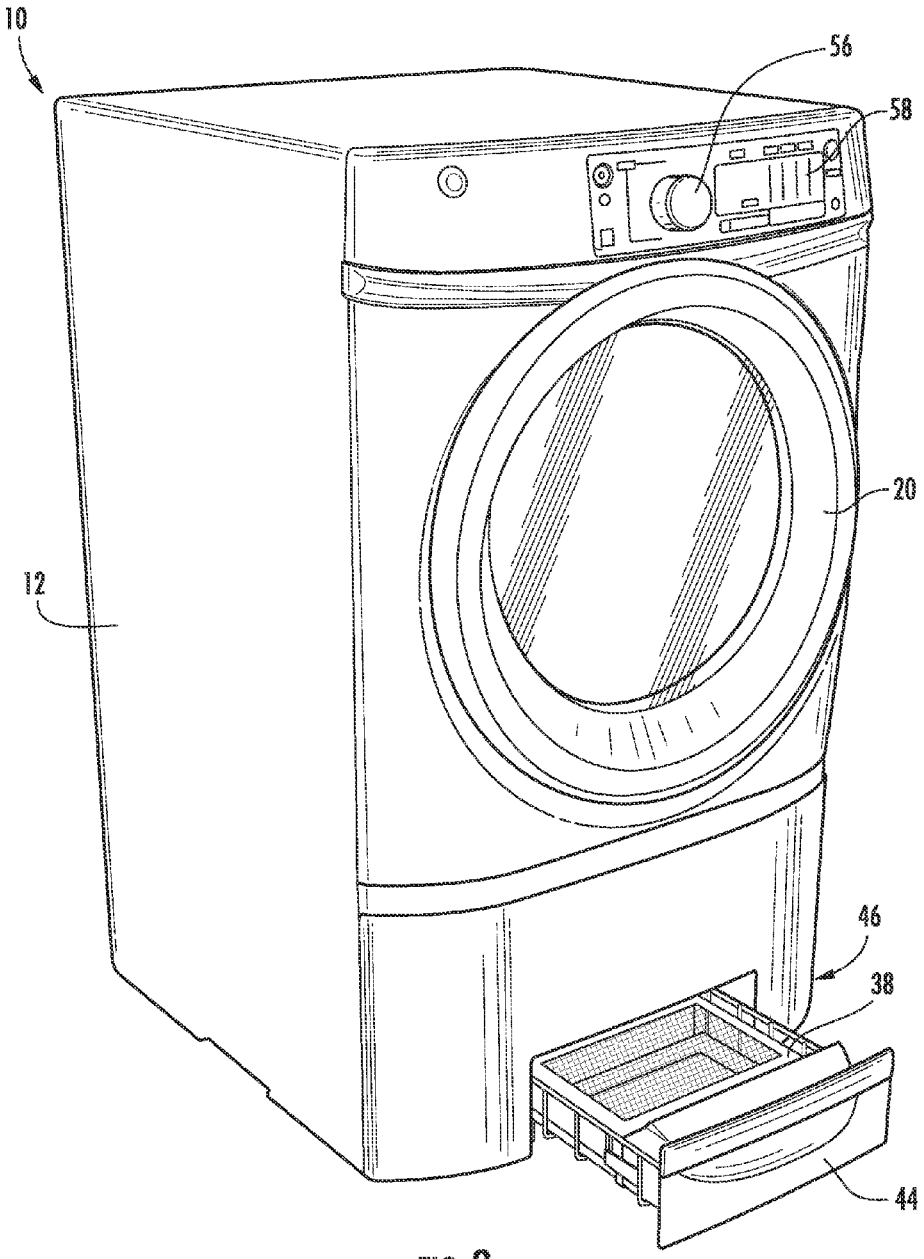

FIGS. 1 and 2 provide perspective views of a dryer appliance 10 according to an exemplary embodiment of the present subject matter. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For example, dryer appliance 10 illustrated in FIGS. 1 and 2 is an electric dryer appliance with electric heating element for heating air. In alternative exemplary embodiments, dryer appliance 10 may be a gas dryer appliance with gas burners for heating air.

Dryer appliance 10 includes a cabinet 12. Within cabinet 12 is a drum or container 14 (FIG. 3) mounted for rotation about a substantially horizontal axis. Drum 14 is generally cylindrical in shape and defines a chamber 16 for receipt of articles for drying. Thus, clothing articles and other fabrics may be loaded into chamber 16 of drum 14 and dried therein, as discussed in greater detail below. A door 20 is rotatably mounted to cabinet 12 to permit selective access to chamber 16 of drum 14.

A drawer 44 is mounted to cabinet 12 at a bottom portion 46 of cabinet 12. Drawer 44 is adjustable (e.g., slidable) between a closed position (FIG. 1) and an open position (FIG. 2). A lint collection bin 38 is removably mounted or positioned within drawer 44. Lint collection bin 38 is configured for collecting and storing lint therein, as discussed in greater detail below. A user of dryer appliance 10 may remove lint collection bin 38 from drawer 44 when drawer 44 is in the open position. With lint collection bin 38 removed from drawer 44, the user may remove lint from lint collection bin 38 and replace lint collection bin 38 within drawer 44 after cleaning lint collection bin 38. The user may adjust drawer 44 to return lint collection bin 38 to a suitable position for collecting lint during operation of dryer appliance 10. A poka-yoke arrangement between lint collection bin 38 and drawer 44 may assist with insuring that lint collection bin 38 is properly or suitably positioned within drawer 44 to capture lint during operation of dryer appliance 10.

Figure 3:
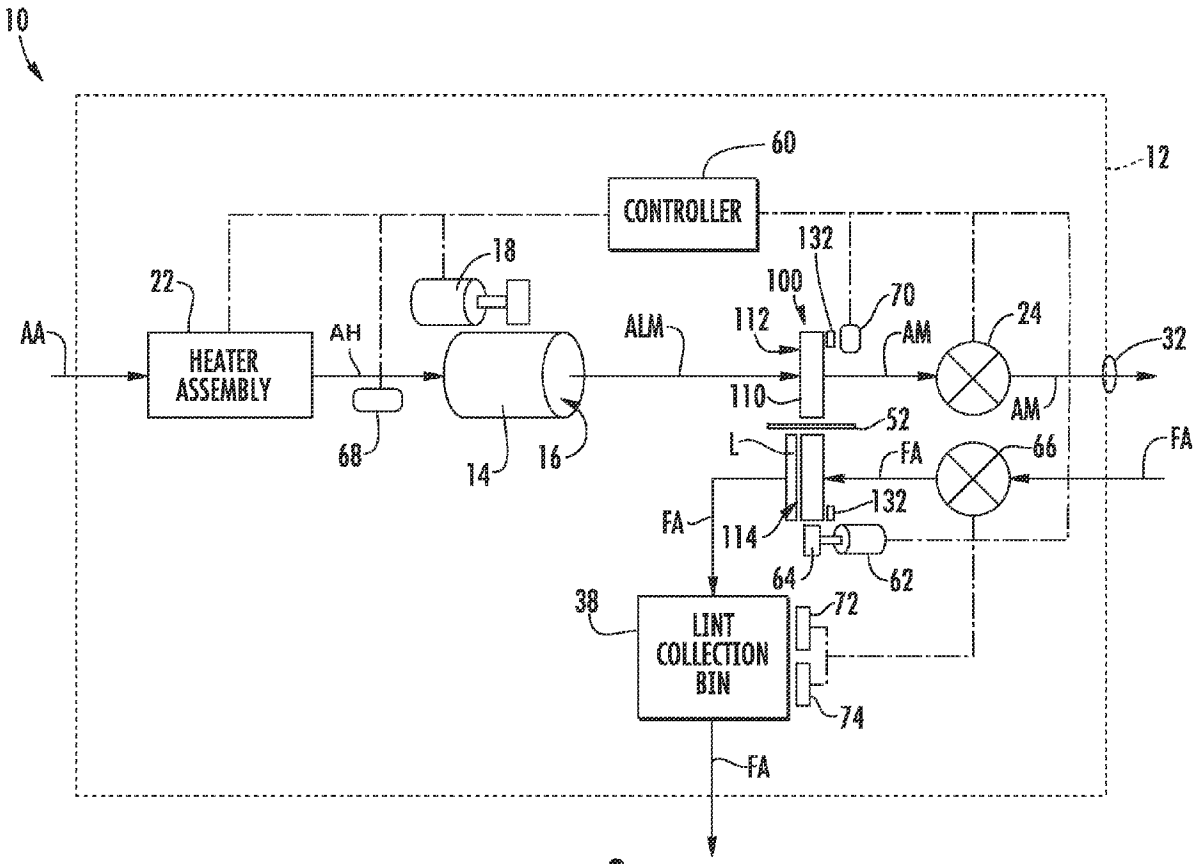
FIG. 3 provides a schematic view of certain components of the exemplary dryer appliance of FIG. 1.

FIG. 3 provides a schematic view of certain components of dryer appliance 10. As may be seen in FIG. 3, dryer appliance 10 includes drum 14 rotatably mounted within cabinet 12. A rear wall (not shown) of drum 14 may be rotatably supported within cabinet 12 by a suitable fixed bearing. A drum motor 18 rotates the drum 14 about a horizontal axis. For example, drum motor 18 may be coupled to drum 14 via a pulley and belt system or drum motor 18 may be directly coupled to drum 14 and directly drive drum 14. Drum motor 18 may also be in mechanical communication with an air handler 24 such that drum motor 18 rotates an impeller assembly (not shown) of air handler 24. Air handler 24 is configured for drawing air through chamber 16 of drum 14, e.g., in order to dry articles located therein as discussed in greater detail below. In alternative exemplary embodiments, dryer appliance 10 may include an additional motor (not shown) for operating air handler 24 independently of drum 14.

Drum 14 is configured to receive heated air that has been heated by a heater assembly 22, e.g., in order to dry damp articles disposed within chamber 16 of drum 14. As discussed above, during operation of dryer appliance 10, drum motor 18 rotates drum 14 and air handler 24 such that air handler 24 draws air through chamber 16 of drum 14. In particular, ambient air, shown with arrow AA, enters heater assembly 22 due to air handler 24 urging such ambient air AA into heater assembly 22. Such ambient air AA is heated within heater assembly 22 and exits heater assembly 22 as heated air, shown with arrow AH. Air handler 24 draws such heated air AH to drum 14. The heated air AH enters drum 14, e.g., through a plurality of holes (not shown) defined in drum 14.

Within chamber 16, the heated air AH accumulates moisture and lint, e.g., from damp articles disposed within chamber 16. In turn, air handler 24 draws lint and moisture laden air, shown as arrow ALM, from chamber 16 to a filter assembly 100 which traps lint L and removes lint particles from the lint and moisture laden air ALM. After filter assembly 100, moisture laden air, shown with arrow AM, is passed through air handler 24. From air handler 24, such moisture laden air AM passes out of clothes dryer 10 through a vent 32 defined by cabinet 12.

Turning back to FIGS. 1 and 2, dryer appliance 10 includes a cycle selector knob 56 mounted on a cabinet control panel 58. Cycle selector knob 56 and other control inputs of cabinet control panel 58 are in communication with a controller 60 (FIG. 3). Turning now to FIG. 3, signals generated in controller 60 operate drum motor 18 and heater assembly 22 in response to a position of selector knob 56. Alternatively, a touch screen type interface may be provided. Controller 60 may include a memory and one or more microprocessors, CPUs or the like, such as general or special purpose microprocessors operable to execute programming instructions or micro-control code associated with operation of dryer appliance 10. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 60 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 60 may be positioned in a variety of locations throughout dryer appliance 10. For example, controller 60 may be located at or adjacent cabinet control panel 58 in cabinet 12. In such an embodiment, input/output ("I/O") signals may be routed between controller 60 and various operational components of dryer appliance 10. As an example, the various operational components of dryer appliance 10 may be in communication with controller 60 via one or more signal lines or shared communication busses.

As discussed above, dryer appliance 10 includes filter assembly 100 for filtering air flowing through dryer appliance 10. Filter assembly 100 includes a filter medium 110 that is rotatably between a first position and a second position, e.g., on a shaft 52. Thus, shaft 52 may support filter medium 110 such that filter medium 110 is rotatable between the first and second positions. In addition, a filter motor 62 is coupled to filter medium 110. Filter motor 62 is operable, e.g., by or with controller 60, to rotate filter medium 110 between the first and second positions. Dryer appliance 10 also includes a fan 66 and lint collection bin 38. Fan 66 is operable, e.g., by or with controller 60, to direct a flow of air FA across or through filter medium 110 to remove lint L from filter medium 110, as discussed in greater detail below.

Filter assembly 100 also includes a pair of magnets 132 and a magnetic sensor 70, such as a Hall effect sensor, a reed switch or a magnetoresistive sensor. Magnets 132 and magnetic sensor 70 assist with establishing whether filter medium 110 is in the first position or the second position. As an example, one of magnets 132 may be positioned adjacent and trigger magnetic sensor 70 when filter medium 110 is in the first position, and another one of magnets 132 may be positioned adjacent and trigger magnetic sensor 70 when filter medium 110 is in the second position.

Dryer appliance 10 also includes a temperature sensor 68, such as a thermocouple or thermistor. Temperature sensor 68 is positioned for measuring or monitoring a temperature of air within chamber 16 of drum 14 or entering chamber 16 of drum 14, e.g., heated air AH. Controller 60 is configured for operating filter motor 62 to move filter medium 110, e.g., when a temperature measurement from temperature sensor 68 exceeds a threshold temperature, as discussed in greater detail below.

Dryer appliance 10 further includes a lint collection bin fullness sensor 72 and a lint collection bin detection sensor 74. Lint collection bin fullness sensor 72 is positioned and configured for establishing whether lint collection bin 38 is full of lint L, e.g., by measuring a volume of lint L in lint collection bin 38 and/or determining when the volume of lint L in lint collection bin 38 exceeds a threshold volume. Lint collection bin fullness sensor 72 may be any suitable type of sensor for determining whether lint collection bin 38 is full. For example, lint collection bin fullness sensor 72 may be an optical sensor, a pressure switch, etc. Lint collection bin detection sensor 74 is positioned and configured for establishing whether lint collection bin 38 is properly positioned within drawer 44. Lint collection bin detection sensor 74 may be any suitable type of sensor for determining whether lint collection bin 38 is properly positioned within drawer 44. For example, lint collection bin detection sensor 74 may be an optical sensor, a contact switch, a pressure switch, etc.

Figure 4:
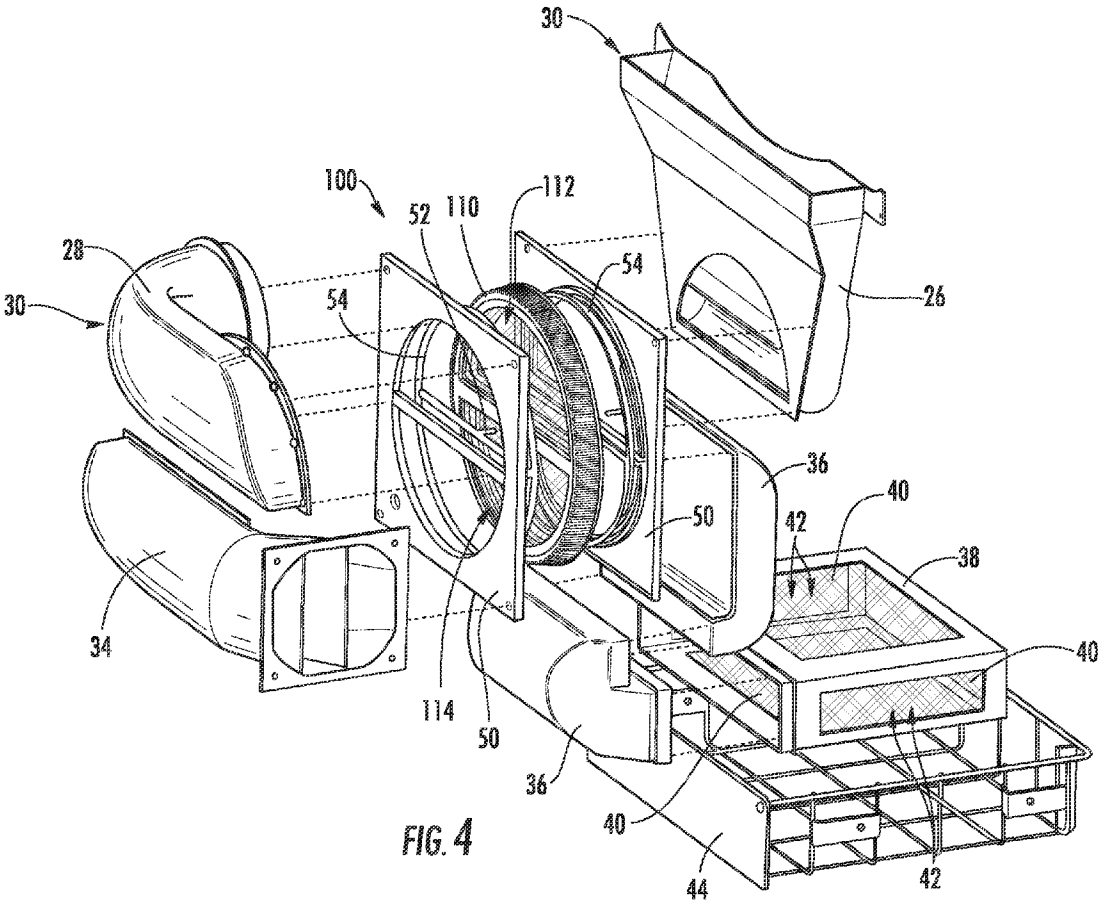
FIG. 4 provides an exploded view of various components of the exemplary dryer appliance of FIG. 1 including a filter assembly of the dryer appliance.

FIG. 4 provides an exploded view of various components of dryer appliance 10 including filter assembly 100. As may be seen in FIG. 4, dryer appliance 10 includes a front duct 26 and an exhaust duct 28 that assist with forming an exhaust conduit 30 that extends between and connects chamber 16 of drum 14 and vent 32 (FIG. 3). Exhaust conduit 30 places chamber 16 of drum 14 and vent 32 in fluid communication in order to permit moisture laden air AM to exit dryer appliance 10. Thus, air may flow through exhaust conduit 30 from chamber 16 of drum 14 to vent 32 of cabinet 12 and exit dryer appliance 10 at vent 32 of cabinet 12.

Filter assembly 100 is positioned at exhaust conduit 30. Filter assembly 100 is configured for filtering air flowing through exhaust conduit 30. In particular, filter assembly 100 may remove or trap lint or other particles from air flowing through exhaust conduit 30.

As may be seen in FIG. 4, filter medium 110 of filter assembly 100 has a first portion 112 and a second portion 114. As discussed above, filter medium 110 is rotatable between the first and second positions. First portion 112 of filter medium 110 is disposed within or at exhaust conduit 30 when filter medium 110 is in the first position. Conversely, second portion 114 of filter medium 110 is disposed within or at exhaust conduit 30 when filter medium 110 is in the second position. Thus, either of first and second portions 112 and 114 of filter medium 110 may be selectively positioned within exhaust conduit 30 in order to filter air flowing through exhaust conduit 30 with either of first and second portions 112 and 114 of filter medium 110.

Filter medium 110 is rotatably mounted to plates 50 with shaft 52. In particular, filter medium 110 is disposed between plates 50, and shaft 52 extends through filter medium 110 between plates 50. Gaskets 54 also extend between plates 50 and filter medium 110. Gaskets 54 assist with containing heated air within exhaust conduit 30 and hinder or prevent leaks therefrom. Plates 50 define passages, e.g., that correspond to or complement first and second portions 112 and 114 of filter medium 110.

Dryer appliance 10 also includes a supply duct 34. Fan 66 (FIG. 3) may be positioned at and/or mounted to supply duct 34. In particular, supply duct 34 may extend between fan 66 and filter medium 110 such that fan 66 directs flow of air FA across or through filter medium 110 to remove lint L from filter medium 110. In particular, fan 66 is operable, e.g., by or with controller 60, to direct flow of air FA through supply duct 34 across second portion 114 of filter medium 110 when filter medium 110 is in the first position or to direct flow of air FA through supply duct 34 across first portion 112 of filter medium 110 when filter medium 110 is in the second position. Lint collection bin 38 is disposed downstream of filter medium 110 relative to flow of air FA from fan 66. For example, a lint duct 36 extends between filter medium 110 and lint collection bin 38. Lint L from filter medium 110 may be directed from filter medium 110 to lint collection bin 38 through lint duct 36. For example, flow of air FA from fan 66 may blow lint L off filter medium 110, and lint L may flow through lint duct 36 to lint collection bin 38. Thus, lint collection bin 38 is configured for collecting lint L blown off filter medium 110 by flow of air FA.

As may be seen in FIG. 4, lint collection bin 38 includes mesh walls 40. Mesh walls 40 define a plurality of outlet holes 42. Flow of air FA exits lint collection bin 38 through outlet holes 42. Outlet holes 42 may be sized for hindering lint L from passing therethrough. Thus, mesh walls 40 may trap lint L within lint collection bin 38 while permitting flow of air FA to exit lint collection bin 38. Lint collection bin 38 may have any suitable size. For example, lint collection bin 38 may be sized for collecting lint for at least ten drying cycles of dryer appliance 10, for at least twenty drying cycles of dryer appliance 10, etc. without requiring or needing a user of dryer appliance 10 to empty or service lint collection bin 38.

Figure 5:
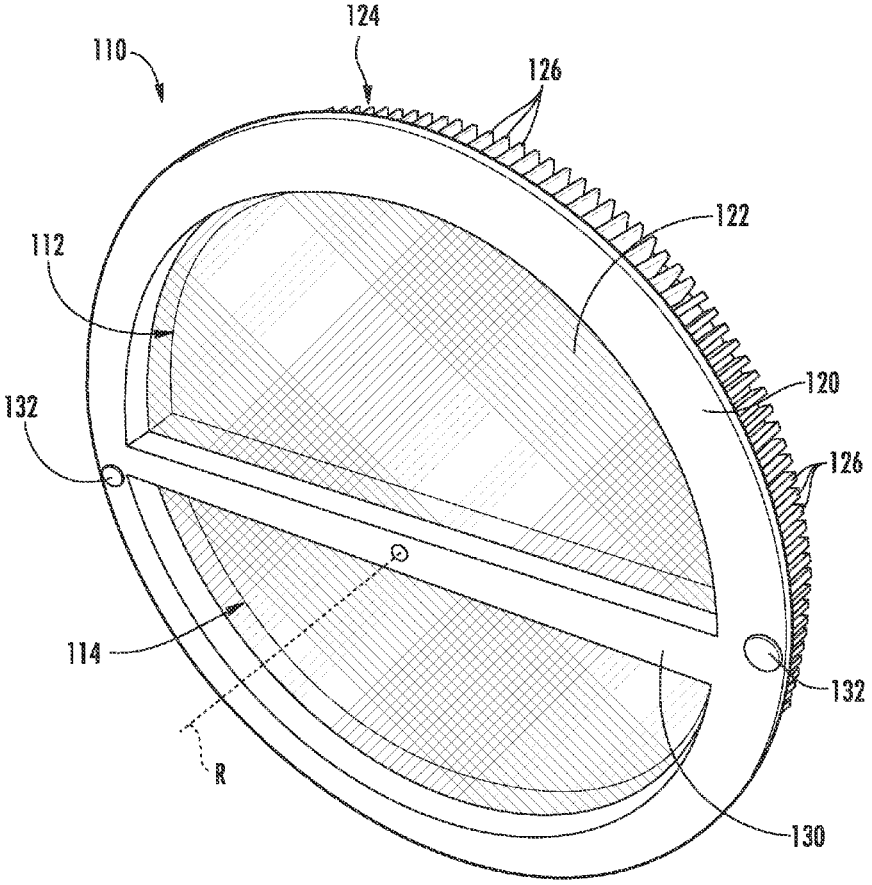
FIG. 5 provides a perspective view of a filter medium of the filter assembly of FIG. 4.

FIG. 5 provides a perspective view of filter medium 110 of filter assembly 100. As may be seen in FIG. 5, filter medium 110 includes a frame 120 and a mesh or screen 122 disposed within frame 120. For example, screen 122 may be sandwiched between two portions of frame 120. Screen 122 may be any suitable screen. For example, screen 122 may be a metal screen or mesh, such as aluminum or steel screen, or a nylon screen. Frame 120 may have any suitable shape. For example, frame 120 may have a circular shape, e.g., in a plane that is perpendicular to an axis of rotation R of filter medium 110, and a middle beam 130 of frame 120 may bisect the interior area of frame 120. Thus, first and second portions 112 and 114 of filter medium 110 may have a semicircular shape, e.g., in the plane that is perpendicular to an axis of rotation R of filter medium 110.

Frame 120 may include or define a plurality of teeth 126. Teeth 126 may be disposed about an outer edge 124 of frame 120, e.g., about or at a circumference of frame 120 when frame 120 has a circular shape. Teeth 126 assist with coupling filter medium 110 to filter motor 62. For example, filter motor 62 may include a gear 64 (FIG. 3), and gear 64 of filter motor 62 may mesh with teeth 126 of frame 120 in order to couple filter motor 62 to filter medium 110 and permit filter motor 62 to rotate filter medium 110 between the first and second positions.

A first one of magnets 132 is mounted to frame 120 at or adjacent first portion 112 of filter medium 110, and a second one of magnets 132 is mounted to frame 120 at or adjacent second portion 114 of filter medium 110. Thus, the position of magnets 132 on frame 120 can assist with determining whether filter medium 110 is in the first or second positions.

Figure 6:
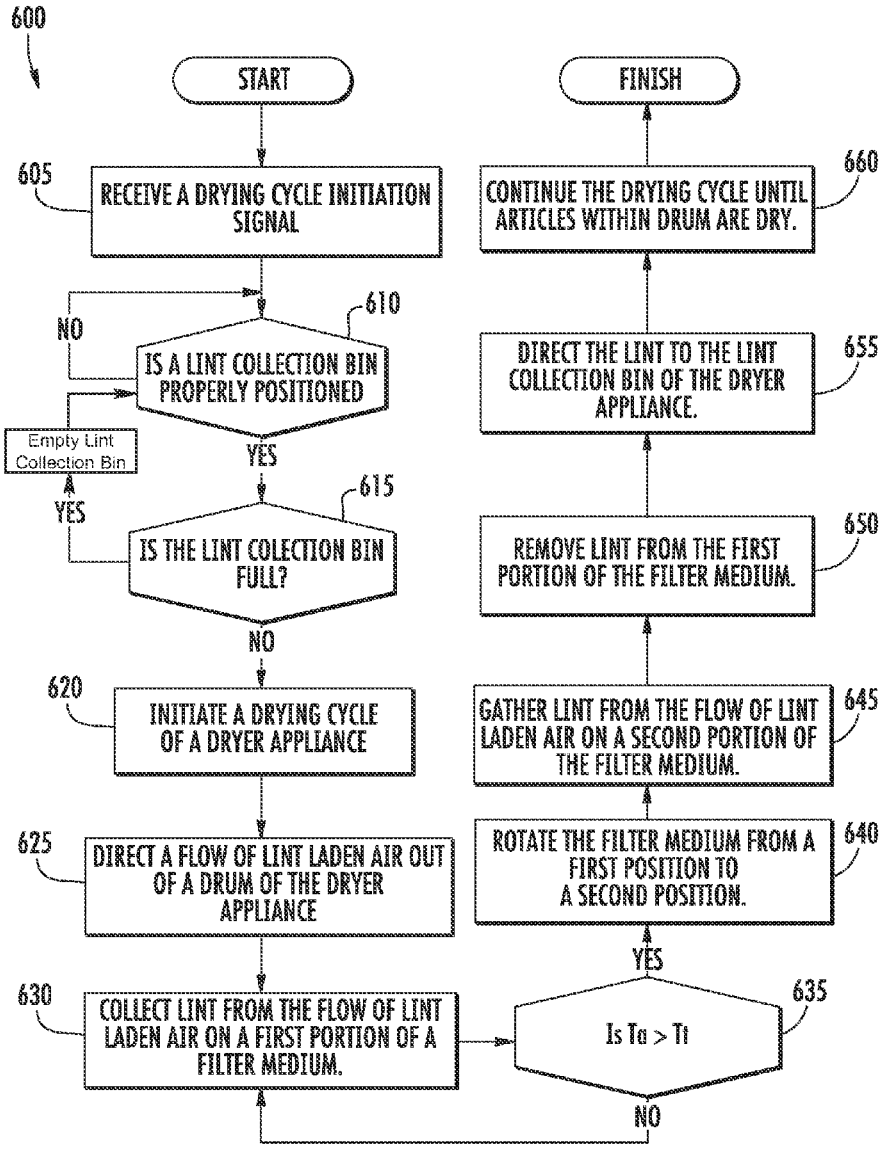
FIG. 6 illustrates a method for operating a dryer appliance according to an exemplary embodiment of the present subject matter.

FIG. 6 illustrates a method 600 for operating a dryer appliance according to an exemplary embodiment of the present subject matter. Controller 60 may be programmed or configured to implement method 600. Utilizing method 600, filter assembly 100 may assist with removing lint L from lint and moisture laden air ALM and the lint L may be stored or collected within lint collection bin 38.

At step 605, a drying cycle intuition signal is received. For example, a user of dryer appliance 10 may utilize cycle selector knob 56 to signal controller 60 at step 605. Thus, the user may signal controller 60 to start a drying cycle of dryer appliance 10 at step 605, e.g., in order to dry clothing articles within chamber 16 of drum 14.

At step 610, it is determined whether lint collection bin 38 is properly positioned, e.g., within drawer 44. For example, lint collection bin detection sensor 74 will be triggered or actuated if lint collection bin 38 is suitably positioned within drawer 44 at step 610. Thus, lint collection bin detection sensor 74 may signal controller 60 if lint collection bin 38 is suitably positioned within drawer 44 at step 610. If lint collection bin detection sensor 74 indicates that lint collection bin 38 is not suitably positioned within drawer 44, controller 60 does not start the drying cycle of dryer appliance 10. Controller 60 also can signal the user of dryer appliance 10 to properly position lint collection bin 38 within drawer 44 and/or close drawer 44 at step 610, e.g., with an indicator or display on cabinet control panel 58. In such a manner, the drying cycle of dryer appliance 10 will not be initiated unless lint collection bin 38 is properly positioned within drawer 44.

If lint collection bin 38 is properly positioned at step 610, it is determined whether lint collection bin 38 is full at step 615. For example, lint collection bin fullness sensor 72 may measure the volume of lint L within lint collection bin 38 at step 615 and signal controller 60 if lint collection bin 38 is full. If lint collection bin 38 is full, controller 60 does not start the drying cycle of dryer appliance 10. Controller 60 also can signal the user of dryer appliance 10 to empty or replace lint collection bin 38 at step 615 if lint collection bin 38 is full, e.g., with an indicator or display on cabinet control panel 58. In such manner, the drying cycle of dryer appliance 10 will not be initiated unless lint collection bin 38 is not full at step 615.

At step 620, the drying operation of dryer appliance 10 is initiated. During the drying cycle, air is heated with heater assembly 22 and drawn through chamber 16 of drum 14 by air handler 24, e.g., in order to dry damp articles disposed within chamber 16 of drum 14, as described above. Drum 14 is also rotated during the drying cycle. Heating and tumbling of the articles within chamber 16 of drum 14 generate lint L within chamber 16 of drum 14.

At step 625, a flow of lint (e.g., and moisture) laden air is directed out of drum 14 during the drying operation. For example, controller 60 may operate air handler 24 to draw the flow of lint laden air out of drum 14 at step 625. At step 630, lint from the flow of lint laden air is collected on first portion 112 of filter medium 110 during the drying operation. Second portion 114 of filter medium 110 is not disposed within the flow of lint laden air during step 650. Thus, filter medium 110 is in the first position at step 630.

At step 635, a temperature, $T_a$, of heated air within or entering drum 14 is established and compared to a threshold temperature, $T_t$, during the drying operation. For example, controller 60 may measure the temperature $T_a$ of heated air within or entering drum 14 with temperature sensor 68 at step 635. Controller 60 may also compare the temperature $T_a$ of heated air within or entering drum 14 to the threshold temperature $T_t$ at step 635. If the temperature $T_a$ of heated air within or entering drum 14 is less than the threshold temperature $T_t$ at step 635, the drying cycle is continued, e.g., until the drying cycle is complete and articles within drum 14 are dry. Conversely, the drying cycle is interrupted if the temperature $T_a$ of heated air within or entering drum 14 is greater than the threshold temperature $T_t$ at step 635. In particular, controller 60 may deactivate heater assembly 22 at step 635 if the temperature $T_a$ of heated air within or entering drum 14 is greater than the threshold temperature $T_t$ at step 635. When the temperature $T_a$ of heated air within or entering drum 14 is greater than the threshold temperature $T_t$, lint L on first portion 112 of filter medium 110 may be restricting air flow out of drum 14.

At step 640, filter medium 110 is rotated from the first position to the second position. For example, controller 60 may operate filter motor 62 to rotate filter medium 110 from the first position to the second position at step 640. In particular, controller 60 may operate filter motor 62 to rotate filter medium 110 until magnetic sensor 70 detects one of magnets 132 at step 640. Controller 60 may also deactivate heater assembly 22 and air handler 24 during step 640. In such a manner, lint L on first portion 112 of filter medium 110 restricting air flow out of drum 14 may be removed from exhaust conduit 30, and second portion 114 of filter medium 110 may be rotated into exhaust conduit 30 and replace first portion 112 of filter medium 110. In particular, after step 640, lint from the flow of lint laden air is gathered on second portion 114 of filter medium 110 during the drying operation at step 645. First portion 112 of filter medium 110 is not disposed within the flow of lint laden air during step 645.

At step 650, lint L is removed from first portion 112 of filter medium 110. For example, after rotating first portion 112 of filter medium 110 out of exhaust conduit 30, controller 60 may operate fan 66 to direct the flow of air FA across or through first portion 112 of filter medium 110 to remove lint L from first portion 112 of filter medium 110 at step 650. As another example, dryer appliance 10 may include a damper for directing air from exhaust conduit 30 across or through first portion 112 of filter medium 110 to remove lint L from first portion 112 of filter medium 110 at step 650. Controller 60 may activate air handler 24 during step 650.

At step 655, lint L that has been blown off first portion 112 of filter medium 110 is directed to lint collection bin 38. For example, the flow of air FA from fan 66 may urge the lint L from filter medium 110 though lint duct 36 to lint collection bin 38 at step 655. Controller 60 may activate air handler 24 during step 655. At step 660, the drying cycle is continued until articles disposed within chamber 16 of drum 14 are dry. Thus, controller 60 may operate heater assembly 22 and air handler 24 to draw heated air through chamber 16 of drum 14 at step 660. In such a manner, lint L may be removed from filter medium 110 and stored or collected within lint collection bin 38.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining a vent;

a drum rotatably mounted within the cabinet, the drum defining a chamber for receipt of articles for drying;

an exhaust conduit extending between the chamber of the drum and the vent of the cabinet to direct an airflow therethrough;

a filter assembly positioned in fluid communication between the exhaust conduit and the vent, the filter assembly comprising a filter medium having a first portion and a second portion, the filter medium rotatable between a first position and a second position, the first portion of the filter medium disposed within the exhaust conduit when the filter medium is in the first position, the second portion of the filter medium disposed within the exhaust conduit when the filter medium is in the second position, and a motor coupled to the filter medium, the motor operable to rotate the filter medium between the first and second positions;

a supply duct extending within the cabinet in fluid isolation from the exhaust conduit to direct a flow of air through the supply duct that is separate from the airflow through the exhaust conduit; and a lint duct in downstream fluid communication with the supply duct to receive at least a portion of the flow of air from the supply duct, wherein the first portion of the filter medium is disposed between the supply duct and the lint duct when the filter medium is in the second position, and wherein the second portion of the filter medium is disposed between the supply duct and the lint duct when the filter medium is in the first position.

2. The dryer appliance of claim 1, wherein the filter assembly further comprises a fan mounted in fluid communication with the supply duct, the fan operable to direct the flow of air across the second portion of the filter medium when the filter medium is in the first position or to direct the flow of air across the first portion of the filter medium when the filter medium is in the second position.

3. The dryer appliance of claim 2, further comprising a lint collection bin disposed downstream of the filter medium and the lint duct relative to the flow of air from the fan, the lint collection bin configured for collecting lint blown off the filter medium by the flow of air from the fan.

4. The dryer appliance of claim 3, wherein the lint collection bin defines a plurality of outlet holes, the flow of air exiting the lint collection bin through the plurality of outlet holes, the plurality of outlet holes sized for hindering lint from passing therethrough.

5. The dryer appliance of claim 3, further comprising a drawer positioned at a bottom portion of the cabinet, the lint collection bin removably mounted within the drawer.

6. The dryer appliance of claim 1, wherein the filter medium comprises a circular frame and a screen disposed within the circular frame, the first and second portions of the filter medium having a semicircular shape.

7. The dryer appliance of claim 6, wherein the circular frame comprises a plurality of teeth disposed about a circumference of the circular frame, the motor having a gear meshed with the teeth of the plurality of teeth of the circular frame in order to couple the motor to the filter medium.

8. The dryer appliance of claim 6, wherein the screen comprises metal screen.

9. The dryer appliance of claim 1, wherein the filter assembly further comprises a shaft supporting the filter medium such that the filter medium is rotatable between the first and second positions.

10. The dryer appliance of claim 1, wherein the filter assembly further comprises a pair of magnets, a magnetic sensor and a controller, a first one of the magnets mounted to the filter medium adjacent the first portion of the filter medium, a second one of the magnets mounted to the filter medium adjacent the second portion of the filter medium, the controller in operative communication with the motor and the magnetic sensor, the controller configured for operating the motor to move the filter medium until the magnetic sensor detects one of the pair of magnets.

11. The dryer appliance of claim 1, further comprising a heater, a temperature sensor and a controller, the heater configured for heating air entering the chamber of the drum, the temperature sensor positioned for measuring a temperature the air entering the chamber of the drum, the controller in operative communication with the heater, the temperature sensor and the motor, the controller configured for deactivating the heater and operating the motor to move the filter medium when a temperature measurement from the temperature sensor exceeds a threshold temperature.

* * * * *